United States Patent [19]

Schwappach

[11] Patent Number: 5,004,397

[45] Date of Patent: Apr. 2, 1991

[54] ATTACHMENT HOLDER FOR INTERCHANGEABLE EQUIPMENT ON THE SUPERSTRUCTURE OF A MOBILE SHOVEL EXCAVATOR

[75] Inventor: Dieter Schwappach, Dortmund, Fed. Rep. of Germany

[73] Assignee: O&K Orenstein & Koppel Aktiengesellschaft, Dortmund, Fed. Rep. of Germany

[21] Appl. No.: 373,933

[22] Filed: Jun. 28, 1989

[30] Foreign Application Priority Data

Jul. 1, 1988 [DE] Fed. Rep. of Germany ..... 3822247

[51] Int. Cl.[5] ..... E02F 3/36

[52] U.S. Cl. ..... 414/686; 414/694

[58] Field of Search ..... 414/686, 694, 695.5, 414/722, 718, 728

[56] References Cited

U.S. PATENT DOCUMENTS

| | | | |
|---|---|---|---|
| 3,534,877 | 10/1970 | Menzi | 414/694 |
| 3,656,640 | 4/1972 | Schwing | 414/694 |
| 4,316,697 | 2/1982 | Yokoyama | 414/694 |
| 4,393,607 | 7/1983 | Hirosawa | 414/694 X |
| 4,444,542 | 4/1984 | Shaw et al. | 414/694 |
| 4,571,147 | 2/1986 | Schaeff | 414/694 X |

*Primary Examiner*—Robert J. Spar
*Assistant Examiner*—Donald W. Underwood
*Attorney, Agent, or Firm*—Martin A. Farber

[57] ABSTRACT

Attachment holder for the operating equipment on the superstructure of a mobile shovel excavator, the attachment holder, which can be attached subsequently, being coupled to the attachment bearing bracket and having, in forward direction, offset horizontally, pivot shafts for the boom and the boom ram.

6 Claims, 1 Drawing Sheet

ATTACHMENT HOLDER FOR INTERCHANGEABLE EQUIPMENT ON THE SUPERSTRUCTURE OF A MOBILE SHOVEL EXCAVATOR

FIELD AND BACKGROUND OF THE INVENTION

The present invention refers to an attachment holder for the operating equipment on the superstructure of a mobile shovel excavator.

A change in the field of operation of excavators frequently has the result that under the new operating conditions it is necessary to lengthen the reach of the equipment. In actual practice this problem arises, for instance, upon a lowering of the level of the working bed, due to a material which has been removed, with respect to a steep wall. The clearance distance of the attachment can be increased. Another example of when it is desired to lengthen the reach of the attachment is when, for purposes of increased economy, it is desired to load transportation vehicles which must remain outside the swivel region of the superstructure on both sides of the excavator.

In principle it would be possible to use other equipment having the correspondingly desired larger dimensions. Such a measure, however, on the one hand results in considerable expense and upon the other hand brings about an increase in the load moment with a shovel of the same size so that greater forces occur in the supports, the speed of use is reduced, and larger boom rams must be employed. Together with this, greater power losses results and expenses increase disproportionately.

An object of the present invention is to create, nevertheless, a greater reach for the excavator shovel at low expense with the use of the attachment parts which are already present.

SUMMARY OF THE INVENTION

According to the invention the attachment holder (7) which can be applied subsequently is coupled to the attachment bearing bracket (5) and has, in the forward direction, horizontally offset, pivot shafts (10, 11) for a boom (2) and a boom ram (6).

The advantage of the invention resides in the fact that the subsequent interposing of a holder attachment between the attachment bearing bracket and the attachment itself, comprising in particular the boom or boom lower part and boom ram, requires little financial expense. Contrary to the prevailing opinion that such an intermediate part cannot withstand the forces which occur, particularly in the case of large machines, this can surprisingly be contradicted by what is known from actual practice.

The moving forward of the attachment advantageously furthermore leads to the boom lower part coming out of the field of view of the driver's cab so that, in particular, loading processes on both sides of the attachment are facilitated and can be more easily viewed.

An increase of the counterweight, which could be necessary in the case of a shovel of the same size, does not as a rule establish any difficulty from a technical standpoint.

If, in accordance with the feature of the invention, the holder attachment is movably coupled with the attachment bearing bracket by at least one adjustment cylinder, then an increase in the working depth or working height of the attachment is furthermore also possible. Depending on the requirements, the adjustment cylinder is then provided in the upper part between the attachment holder and the attachment bearing bracket or else in the lower part and the other shaft bearing is made moveable.

Particularly for the use of large shovels in heavy rock, the attachment holder is welded firmly to the attachment bearing bracket.

BRIEF DESCRIPTION OF THE DRAWING

With the above and other objects and advantages in view, the present invention will become more clearly understood in connection with the detailed description of preferred embodiments, when considered with the accompanying drawing, of which.

DETAILED DESCRIPTION OF THE PREFERRED EMBODIMENTS

Figure 1:
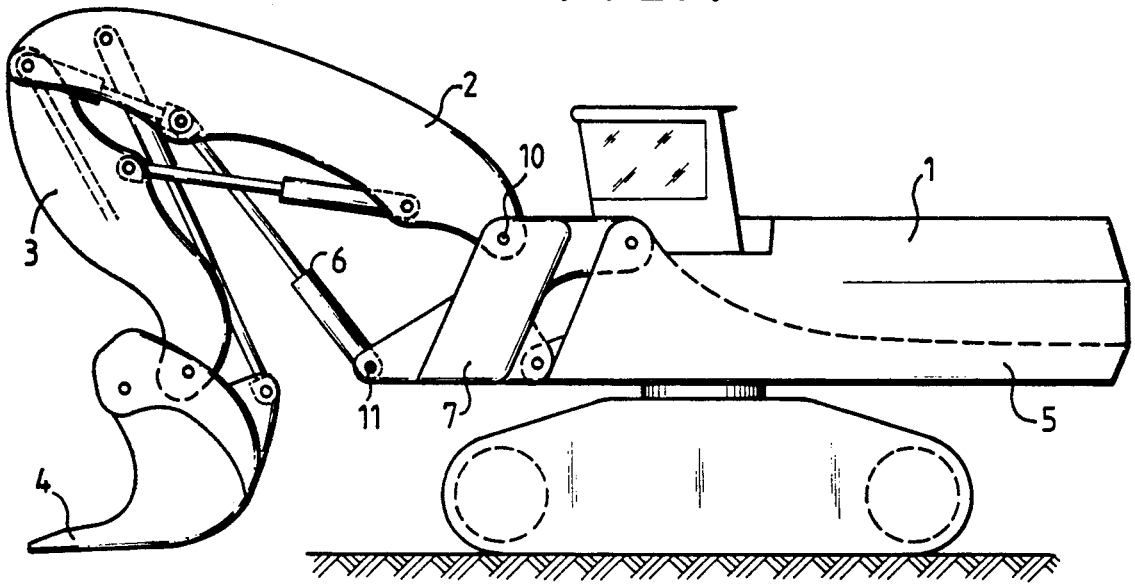
FIG. 1 is a side elevational view showing the superstructure of a mobile excavator.

FIG. 1 shows the superstructure 1 of a mobile shovel excavator having a boom 2, its stick 3 and its shovel 4. Between the attachment bearing bracket 5 and the attachment, and in particular between the boom 2 and the boom ram 6, there can be noted, in accordance with the invention, an attachment holder 7 which can be additionally added on subsequently. FIG. 1 shows that it is coupled on the one side to the attachment bearing bracket 5 and that in the forward direction, offset horizontally, it has pivot shafts 10 and 11 for the boom 2 and the boom ram 6, respectively.

Figure 2:
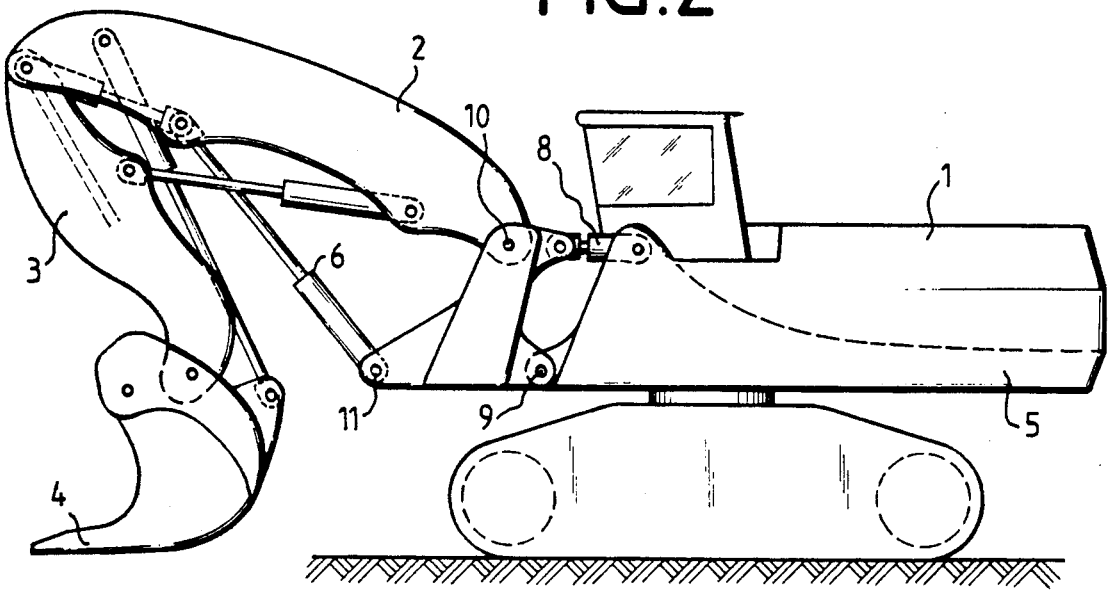
FIG. 2 is a side elevational view showing another embodiment showing the superstructure of a mobile excavator.

The arrangement of FIG. 2 shows, as a modification, that the attachment holder 7 is coupled movably to the attachment bearing bracket 5 by an adjustment cylinder 8. In This case the mount 9 which is then provided in the lower part is moveable.

The modification in which the attachment holder 7 is welded to the attachment bearing bracket 5 has not been shown in detail. Such a modification is employed if retrofitting of the attachment is not possible.

I claim:

1. An attachment holder for operating equipment on a superstructure of a mobile shovel excavtor having an attachment bearing bracket with horizontal first bearings, the operating equipment comprising a boom and boom ram having respective horizontal second bearings normally connected to said first bearings of the attachment bearing bracket, comprising an attachment holder, selectively appliable subsequently to the excavator, coupled to the attachment bearing bracket and having, in a forward direction, means comprising horizontal pivot shafts for connecting said second bearings of the boom and the boom ram therewith, said pivot shafts being horizontally offset, and said attachment holder has means comprising horizontal connection points for connecting said attachment bearing bracket thereto via said horizontal first bearings, said connection points being rearwardly spaced from said pivot shafts.

2. An attachment holder for operating equipment on a superstructure of a mobile shovel excavator having an attachment bearing bracket with first bearings, the operating equipment comprising a boom and boom ram having respective second bearings normally connected to said first bearings of the attachment bearing bracket, comprising an attachment holder, appliable subsequently to the excavator, coupled to the attachment bearing bracket and having, in a forward direction, means comprising pivot shafts for connecting said second bearings of the boom and the boom ram therewith, said pivot shafts being horizontally offset, and said attachment holder has means comprising connection points for connecting said attachment bearing bracket thereto, said connection points being rearwardly spaced from said pivot shafts, and at least one adjusting cylinder connected to one of said connection points and one of said first bearings movably coupling the attachment holder to the attachment bearing bracket.

3. The attachment holder according to claim 2, further comprising another coupling connected to the other of said connection points and the other of said first bearings couples the attachment holder to the attachment bearing bracket, said another coupling is a movable coupling comprising a movable shaft bearing.

4. An attachment holder for operating equipment on a superstructure of a mobile shovel excavator having an attachment bearing bracket with first bearings, the operating equipment comprising a boom and boom ram having respective second bearings normally connected to said first bearings of the attachment bearing bracket, comprising an attachment holder, applicable subsequently to the excavator, coupled to the attachment bearing bracket and having, in a forward direction, means comprising pivot shafts for connecting said second bearings of the boom and the boom ram therewith, said pivot shafts being horizontally offset, and said attachment holder has means comprising connection points for connecting said attachment bearing bracket thereto, said connection points bearing rearwardly spaced from said pivot shafts, and wherein the attachment holder is welded at at least one of said connection points to the attachment bearing brackets.

5. An attachment holder for operating equipment on a superstructure of a mobile shovel excavator having an attachment bearing bracket with first bearings, the operating equipment comprising a boom and boom ram having respective second bearings normally connected to said first bearings of the attachment bearing bracket, comprising an attachment holder, appliable subsequently to the excavator, coupled to the attachment bearing bracket and having, in a forward direction, means comprising pivot shafts for connecting said second bearings of the boom and the boom ram therewith, said pivot shafts being horizontally offset, and said attachment holder has means comprising connection points for connecting said attachment bearing bracket thereto, said connection points being rearwardly spaced from said pivot shafts, and wherein said connection points of said attachment holder are connected to said first bearings of said attachment bearing bracket.

6. The attachment holder according to claim 1, wherein said second bearings of said boom and boom ram are lower bearings of said boom and boom ram.

* * * * *